US007040234B1

(12) United States Patent
Maurer et al.

(10) Patent No.: US 7,040,234 B1
(45) Date of Patent: May 9, 2006

(54) MEMS SAFE ARM DEVICE FOR MICRODETONATION

(75) Inventors: Walter H. Maurer, Ridgecrest, CA (US); Gabriel H. Soto, Ridgecrest, CA (US); David R. Hollingsworth, Fallon, NV (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 159 days.

(21) Appl. No.: 10/901,393

(22) Filed: Jul. 22, 2004

(51) Int. Cl.
*F42C 15/18* (2006.01)

(52) U.S. Cl. ..... 102/226; 102/221; 102/202.7; 102/254; 102/200

(58) Field of Classification Search ..... 102/226, 102/221, 202.7, 254, 200
See application file for complete search history.

(56) References Cited

U.S. PATENT DOCUMENTS

| | | | | |
|---|---|---|---|---|
| 5,705,767 | A * | 1/1998 | Robinson | 102/231 |
| 6,167,809 | B1 * | 1/2001 | Robinson et al. | 102/235 |
| 6,244,184 | B1 * | 6/2001 | Tadmor | 102/266 |
| 6,314,887 | B1 * | 11/2001 | Robinson | 102/262 |
| 6,431,071 | B1 | 8/2002 | Hodge et al. | |
| 6,439,119 | B1 * | 8/2002 | Smith et al. | 102/221 |
| 6,568,329 | B1 | 5/2003 | Robinson | |
| 2003/0070571 | A1 * | 4/2003 | Hodge et al. | 102/221 |

* cited by examiner

*Primary Examiner*—M. Clement
(74) *Attorney, Agent, or Firm*—Laura R. Foster

(57) ABSTRACT

The present invention relates to a device for electronically arming and firing a MEMS-scale interrupted explosive train to detonate a main charge explosive. The device includes a MEMS slider assembly housing a transfer charge electrically actuated to move between safe and armed positions of the explosive train.

16 Claims, 2 Drawing Sheets

MEMS SAFE ARM DEVICE FOR MICRODETONATION

CROSS-REFERENCE TO RELATED APPLICATIONS

This application is co-pending and was concurrently filed with U.S. patent application having Navy Case No. 96531.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The present invention relates generally to safe and arm devices and more particularly to microelectromechanical systems (MEMS) safe and arm (also known as "safe arm") devices for electrically arming an interrupted microexplosive train to detonate a main charge explosive.

BACKGROUND OF THE INVENTION

The primary purpose of a safe and arm device is to prevent accidental functioning of a main charge of explosive (military or otherwise) prior to arming, and to allow an explosive train of smaller charges to detonate the main charge after arming. An explosive train is one form of an energy transfer mechanism. It typically begins with a very sensitive primary explosive that initiates detonation, continues through one or more less sensitive booster explosives that transmit and augment the detonation reaction, and finally terminates in detonation of a relatively large and insensitive main charge explosive to achieve the end result.

In an interrupted "out-of-line" explosive train, the sensitive primary explosive is physically separated from the booster explosive by an interrupter or barrier component of the safe and arm device. The barrier component, typically a slider or rotor, interrupts the explosive path and thus prevents detonation of the booster and main charge prior to arming. Arming occurs by moving the explosive train barrier component to align the explosive train's elements.

Conventional mechanical safe-arm devices (MSADs) employing interrupted explosive trains are relatively large & heavy, typically the size of a 12-ounce soda can and weighing several pounds. They are much too large for use in submunitions or micro "new tech" weapons. Furthermore, in the early 1990's, mechanically-based out-of-line technology gave way to the newer Electronic Safe-Arm Device (ESAD) technology which features an uninterrupted "in-line" explosive train containing no sensitive explosive components. However, ESADs, being exclusively electrical, contain much circuitry and many components which are physically large due to high-voltage ratings and/or derating requirements. Thus, existing safe-arm technology, whether out-of-line (MSAD) or in-line (ESAD), is not suitable for emerging small technology applications requiring safe and arm devices.

Micro-electromechanical systems (MEMS) have become known to a degree. The MEMS devices reported in the literature represents an achievement milestone in miniaturization and integration of electromechanical machines and devices. That technology provides, as example, a toothed gear that is smaller in size than a speck of dust, invisible to the eye. MEMS devices are sometimes fabricated by employing the photo-lithograph mask and etch techniques familiar to those in the semiconductor fabrication technology to form micro-miniature parts of silicon or other materials.

SUMMARY OF THE INVENTION

An embodiment of the present invention includes a MEMS type safe arm device for microdetonation including: a circuit board having a slider inductor, with at least one lockpin inductor and at least one alignment pin; an initiator charge plate aligned with the circuit board, and a bridgewire adjacent to an initiator charge that when activated provides a sufficient temperature rise to detonate the initiator charge; an input charge plate aligned with the initiator charge plate including an input charge; a transfer charge assembly aligned with the input charge plate and having a safe position and an armed position activated in response to the application of an electric signal; and a MEMS safety structure with a slider operatively coupled to the MEMS safety structure by a slider spring. The slider includes an elongated axis, a transfer charge cavity housing a transfer charge, and a slider magnet cavity housing a slider magnet. The slider includes a set of safe indentations and a set of armed indentations, and is operatively dimensioned and configured to slide along the elongated axis responsive to the operation of the slider inductor. The MEMS safety structure further includes at least one lockpin operably connected to the MEMS safety structure by a lockpin spring, each having a lockpin magnet cavity housing a lockpin magnet. Each lockpin is operatively dimensioned and configured to move in and out of the safe indentations and the armed indentations responsive to the operation of the lockpin inductor. An output charge plate is aligned with the transfer charge assembly and includes an output charge. The input charge and the output charge are located apart from one another along a charge axis perpendicular to the elongated axis of the slider so that in the safe position the lockpin rests within the set of safe indentations, and the slider is located so that the transfer charge is apart from and non-aligned with the charge axis between the input charge and the output charge. In the armed position, the lockpin inductor affects the movement of the lockpin to retract from the set of safe indentations, and the slider inductor affects the movement of the slider along the elongated axis of the slider aligning the transfer charge with the charge axis, and locating the input charge and the output charge so that upon the detonation of the initiator charge the input charge detonates, and the transfer charge carries a detonation wave across to the output charge, thereby detonating the output charge.

Another embodiment of the present invention includes a method for utilizing a MEMS safe arm device for microdetonation including providing a safe arm device as discussed above; operating the lockpin inductor to affect the movement of the lockpin to retract from the set of safe indentations, operating the slider inductor to affect the movement of the slider along the elongated axis of the slider aligning the transfer charge with the charge axis, and locating the transfer charge adjacent to the input charge and the output charge, thereby the device being operable in the armed position.

Another embodiment of the present invention further includes providing means for activating the bridgewire that is adjacent to the initiator charge. The bridgewire, when activated, providing a sufficient temperature rise to detonate the initiator charge, the detonation of the initiator charge affecting the detonation of the input charge, the detonation of the input charge affecting the detonation of the transfer charge, the transfer charge carrying a detonation wave across to the output charge affecting the detonation of the output charge, and the output charge detonation thereby affecting the detonation of a main charge (not shown).

It is to be understood that the foregoing general description and the following detailed description are exemplary only and are not to be viewed as being restrictive of the present invention as claimed. These and other objects, features and advantages of the present invention will become apparent after a review of the following detailed description of the disclosed embodiments and the appended claims.

DETAILED DESCRIPTION OF THE INVENTION

Embodiments of the present invention include a device and method for electronically arming an interrupted explosive train to detonate a main charge explosive. It should be understood that the examples and embodiments described herein are for illustrative purposes only and that various modifications or changes in light thereof will be suggested to persons skilled in the art and are to be included within the spirit and purview of this application and the scope of the appended claims.

Interrupted Explosive Train

Figure 1A:
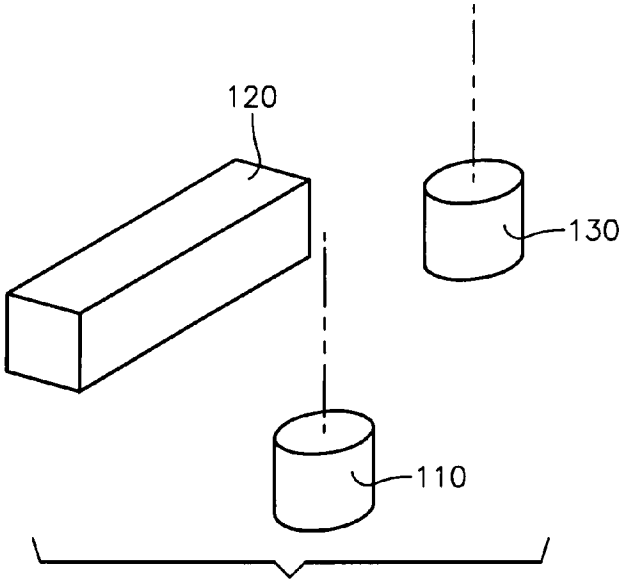
FIGS. 1A–B illustrates a perspective view of an interrupted explosive train according to an embodiment of the present invention.
Figure 1B:
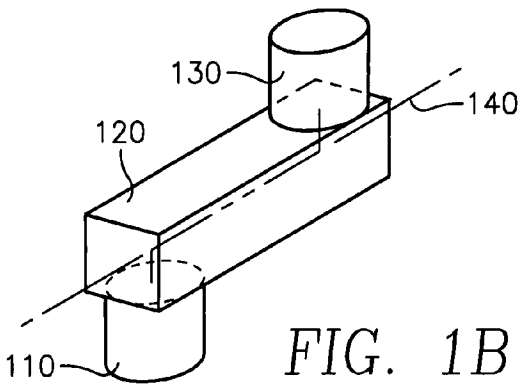

Referring to the drawings, wherein elements are identified by numbers and like elements are identified by like numbers throughout the figures, FIGS. 1A and 1B illustrate safe and armed positions of an interrupted explosive train according to embodiments of the present invention. As shown in FIG. 1A (in the safe position), the input charge 110 is physically separated and misaligned from the output charge 130, preventing the output charge 130 from detonating in the event that the input charge 110 detonates accidentally. FIG. 1B depicts an embodiment of the present invention in an armed position wherein a transfer charge 120 is aligned with the input charge 110 and the output charge 130. It is noteworthy that the three charges are explosive charges, not pyrotechnic charges. Each of the charges has a mass of less than about 1 milligram. The input and output charges have dimensions less than about 1 millimeter. When in the armed position, the transfer charge carries the detonation wave of the input charge 110 across to the output charge 130, thereby detonating the output charge.

Transfer Charge Assembly

Figure 2:
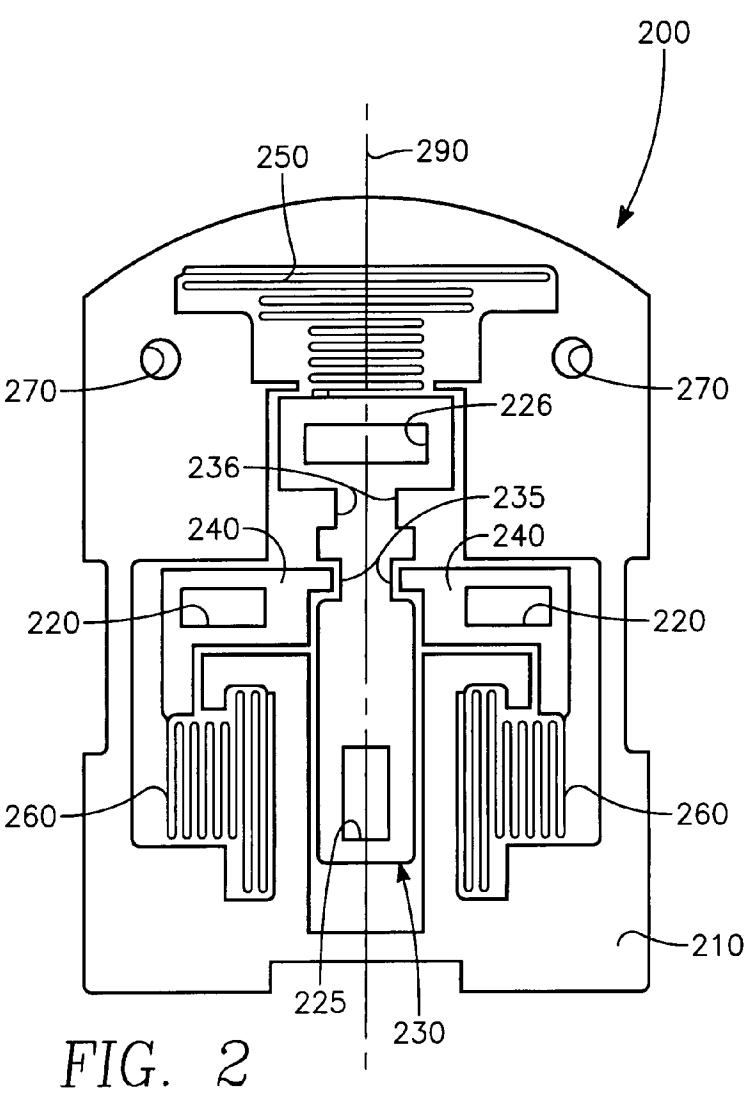
FIG. 2 illustrates a top view of a transfer charge assembly according to an embodiment of the present invention.

FIG. 2 illustrates a transfer charge assembly 200 according to embodiments of the present invention. The transfer charge assembly 200 includes a MEMS safety structure 210, lockpin magnets 360 (shown in FIG. 3), slider magnet 370 (shown in FIG. 3) and a transfer charge 120 (shown in FIG. 3). The transfer charge assembly's function is to align (and to prevent alignment of) the transfer charge 120 with the fixed input and output charges as illustrated in FIGS. 1A–1B.

The MEMS safety structure 210 is a multi-thickness element constructed of a metal material that is more shock-resistant than the brittle silicon materials often employed in MEMS applications. The MEMS safety structure 210 includes a slider 230, lockpins 240, lockpin springs 260 and a slider spring 250 which are all fabricated in situ, thus requiring no installation or assembly. In one embodiment, the MEMS safety structure is a precision-electroformed dual-thickness element having springs (250 and 260) of lesser thickness than the lockpins 240 and slider 230. Although FIG. 2 illustrates an embodiment of the present invention including 2 lockpins, those of ordinary skill in the art will readily acknowledge that including one or more lockpins would not depart from the scope of the present invention.

The spring-mounted lockpins 240 protrude into the set of first indentations 235 in the slider (230), thereby preventing arming, i.e. preventing slider translation out of its safe position. The transfer charge 120 is not aligned with the output charge 130 in the safe position as shown in FIG. 1A. In the safe position, the output charge 130 cannot be detonated.

The slider spring 250 and the lockpin springs 260 hold the slider 230 and lockpins 240 in the safe position. The spring constants are dependant upon the total number of beam elements (analogous to coils in helical springs) and beam element dimensions (length, width, and thickness). In one embodiment, small-valued spring constants are dictated by the low forces of less than 1 mN generated by the inductor/magnet actuation (discussed below). Inclusion of several springs within the application-limited perimeter of the MEMS safety structure 210 requires that spring thickness (e.g. 50 microns) must be substantially less than the overall structure thickness (e.g. 250 microns) to obtain sufficiently low spring constants for compatibility with low actuation forces. Conversely, relatively thick lockpins and slider are required such that their cavities are of sufficient depth to adequately house the miniature magnets and transfer charge. Furthermore, lockpins 240 are safety-critical elements whose purpose is to prevent slider 230 translation out of the safe position. The lockpins 240 prevent the movement of slider 230 by fitting into a set of first indentations 235 (safe position) on the slider. Thus, lockpins 240 are of sufficient thickness to prevent slider 230 motion when engaged, and of sufficient mechanical strength to withstand worst-case loads (for example, impacts or inertia loading of the slider). In one embodiment, two lockpins 240 are provided in accordance with military safe arm safety requirements per MIL-STD-1316 and STANAG 4187 requiring at least two safety features (as is shown in FIG. 2).

Figure 3:
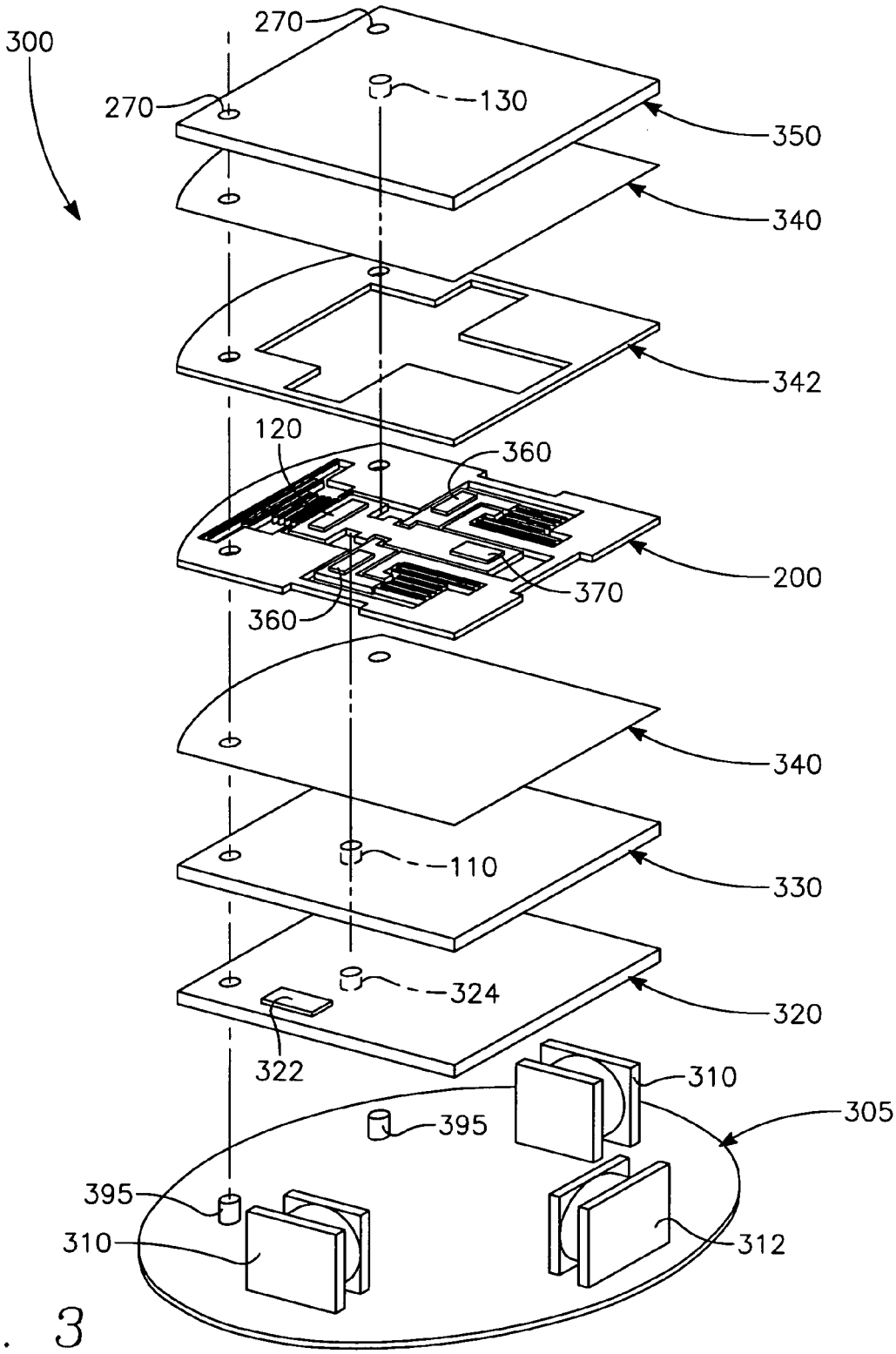
FIG. 3 illustrates an exploded perspective view of a safe arm device according to an embodiment of the present invention.

Referring to FIGS. 2 and 3, (showing the device in the safe position) miniature rare-earth permanent magnets (360 and 370) are installed in the slider magnet cavity 225 and in the lockpin magnet cavities 220, respectfully. Each structure containing a magnet functions as a rotor that responds to an electromagnetic field generated by a stator, i.e. a fixed surface-mount inductor (310 or 312). Correct operation of the invention depends upon correct installation of magnets with respect to inductor polarity. In one embodiment of the present invention, correct installation may be ensured by means of a geometric feature (e.g. chamfered corner) that is common to both the magnet and its containment cavity.

The transfer charge 120 is a pressed or machined pellet, or a casting, of insensitive explosive material such as, for example, a suitable high output secondary explosive capable of small diameter initiation, such as CL-20 with a binder. In one embodiment, the transfer charge 120 is housed in a sleeve to increase confinement and therefore explosive output power. Whether sleeveless or sleeved, the transfer charge 120 is placed in the slider's transfer charge cavity 226. In another embodiment, castable explosive material is cast directly into the slider's transfer charge cavity 226. In another embodiment, the transfer charge 120 is made of a primary explosive. The transfer charge 120 perpetuates the explosive reaction from the input charge 110 to the output charge 130 when in the armed position (as shown in FIG. 1B).

Safe Arm Device

FIG. 3 illustrates a safe arm device 300 according to an embodiment of the present invention. An embodiment of the safe arm device 300 includes a circuit board 305 containing surface mounted electromagnetic inductors 310 connected to a number of ultra thin component plates and aligned via alignment holes 270 on each plate. An initiator charge plate 320 houses an initiator bridgewire 322 and an initiator charge 324 of a sub-milligram amount of sensitive primary explosive (such as, for example, lead azide) placed in direct contact with the bridgewire 322.

An input charge plate 330 including input charge 110 is covered in one embodiment with a sealing plate 340. The input charge 110 includes a sub-milligram amount of sensitive primary explosive material. In another embodiment, the input charge 110 includes a plurality of pressed or cast layers of explosive (not shown) including at least one layer of sensitive primary explosive material and successive layers of decreasingly sensitive material. The input charge 110 is placed in contact with the initiator charge plate 320 such that its most sensitive explosive material is located in direct contact with the initiator charge 324. In another embodiment, the input charge (110) includes one pressed or cast primary explosive material.

The transfer charge assembly 200 is aligned in the safe arm device 300 and its surfaces may be covered with very thin plates or foils such as, for example, sealing plate(s) 340 and/or spacer(s) 342 to protect and environmentally seal the transfer charge (120). Presence or absence of optional items such as sealing plates and spacers is construction-specific. In one embodiment, the transfer charge assembly (200) bottom surface rests and slides upon sealing plate (340). In another embodiment, the transfer charge assembly 200 may be sandwiched between two plates to realize a modular transfer charge package. Spacers 342 are used when required to achieve precise vertical clearances between fixed and moving explosive surfaces; such clearances must be large enough to permit relative motion, but small enough to ensure detonation transfer across air gaps.

The safe arm device 300 includes an output charge plate 350 housing the sub-milligram output charge 130 including insensitive explosive material capable of small diameter initiation such as, for example CL-20 with a binder. The output charge 130 includes at least one pressed or cast insensitive explosive material (such as, for example, military approved secondary explosives). In another embodiment, the size of output charge 130 is increased to produce a larger detonation. In yet another embodiment, the shape of the output charge is altered (such as for example, a pellet rather than a cylinder) to route detonation along a desired path. The output charge plate 350 is located in a fixed out-of-line position relative to the input charge 110 (as illustrated in FIGS. 1A–B). To prevent the sympathetic detonation of either the input charge 110 or output charge 130 by the other, the charges are separated by a distance equal to at least the diameter of the larger charge. Thus the output charge 130 cannot be detonated directly by the input charge 110 due to their axial misalignment. The output charge 130 can only be detonated by the transfer charge 120 in its in-line position (see FIG. 1B).

By definition, the relative positions of an interrupted train's explosive components are safety-critical. In an embodiment of the present invention, functional elements of the safe arm device 300 are practically implemented in the form of thin plates (such as plates shown in FIG. 3) produced by photolithograpically-based fabrication processes that afford excellent dimensional control of element features and locations. In addition, all plates possess a common alignment hole 270 pattern that allows them to be precisely aligned and positioned with respect to each other by means of vertically-positioned alignment pins 395 that are fixed in the circuit board 305. Thus the circuit board 305, which receives electrical actuation and firing signals from an external source (not shown), also serves as the device's mechanical substrate.

Each electromagnetic actuator includes an inductor/electromagnet (310 and 312) permanently located in close proximity to a rare-earth permanent magnet (360 and 370) housed in caivites (220 and 225) on the spring-mounted structures (230 and 240) on the transfer charge assembly 200. When electrically energized by an external source the miniature surface-mount inductor (310 and 312) attracts or repels its associated magnet-bearing structure (240 or 230), thereby achieving the desired actuation. Because the inductor core (not shown) is made of magnetic ferrite material, there is always an attractive force between the respective magnets and inductors whose magnitude depends upon their separation distance.

Performance characteristics of a particular actuator are governed by several factors including separation distance between the respective magnets and inductors; net magnetic force between magnet and inductor when the latter is un-energized, positively energized, or negatively energized; and the mass and spring constant of the spring-mounted structure. Furthermore, an actuator may be constructed to be either latching or non-latching as a function of its spring constant. For a latching actuator, the attractive force between its spring-mounted magnet and de-energized inductor exceeds the spring return force, forcing the magnet to remain in its displaced (full stroke) position until repelled by an inductor field of opposite polarity and sufficient magnitude to break the attraction. Conversely, for a non-latching actuator the spring return force exceeds the attractive force between magnet and de-energized inductor, forcing the magnet to return to its un-displaced (zero) position.

Operation of the Safe Arm Device

To arm the safe arm device 300, each lockpin 240 must be retracted out of the slider's set of first indentations 235 by an externally-supplied electrical signal of correct polarity applied to its associated lockpin inductor 310. Upon retraction of the lockpins 240, the slider 230 will translate to its armed position when an externally-supplied electrical signal of correct polarity is applied to its associated slider inductor 312. In the armed position, the transfer charge 120 is in-line with the output charge 130 and the input charge 110 as illustrated in FIG. 1B. In this position, the output charge 130 will promptly detonate when an externally-supplied electrical firing signal is applied to the initiator charge plate's bridgewire 322.

In an embodiment of the present invention, the circuit board 304 includes a heating element type bridgewire 322 that is electrically connected to the fuze firing circuit (not shown). The bridgewire 322 exhibits a temperature rise sufficient to initiate sustained reaction of the initiator charge 324. The initiator charge 324 includes a primary explosive (such as, for example lead azide) and creates an explosive reaction from the hot bridgewire 322 and subsequently produces an explosive output sufficient to initiate the input charge 110 with which it is in close contact.

The slider 230 is locked in the armed position by causing at least one lockpin 240 to operate so that it protrudes into a set of second indentations (armed position) 236 in the slider 230. When desired, a return to the safe position is subsequently accomplished by providing a proper sequence of inductor signals of proper polarity. In another embodiment, the transfer charge assembly may include a simple mechanical feature (such as a latch or pin) that permanently locks the slider 230 in its armed position. Once permanently locked, subsequent inductor actuations would have no effect upon the slider 230.

Method for Microdetonation

Another embodiment of the present invention includes a method for utilizing a MEMS safe arm device for microdetonation including providing a safe arm device as discussed previously; operating the lockpin inductor (310) to affect the movement of the lockpin (240) to retract from the set of safe indentations (235), operating the slider inductor (312) to affect the movement of the slider (230) along the elongated axis (290) of the slider (230) aligning the transfer charge (120) with the charge axis (140) and locating the transfer charge (130) adjacent to the input charge (110) and the output charge (130), thereby the device being operable in the armed position.

Another embodiment of the present invention further includes providing means for activating the bridgewire (322), the bridgewire (322) being adjacent to the initiator charge (324). The bridgewire (322), when activated, providing a sufficient temperature rise to detonate the initiator charge (324), the detonation of the initiator charge (324) affecting the detonation of the input charge (110), the detonation of the input charge (110) affecting the detonation of the transfer charge (120), the transfer charge (120) carrying a detonation wave across to the output charge (130) affecting the detonation of the output charge (130), the output charge (130) detonation thereby affecting the detonation of a main charge (not shown).

Although the description above contains much specificity, this should not be construed as limiting the scope of the invention but as merely providing an illustration of the presently preferred embodiment of the invention. Thus the scope of this invention should be determined by the appended claims and their legal equivalents.

What is claimed is:

1. A MEMS type safe arm device for microdetonation comprising:

a circuit board (305) having a slider inductor (312), at least one lockpin inductor (310) and at least one alignment pin (395) mounted thereon;

an initiator charge plate (320) positioned above and aligned with said circuit board (305) via at least one alignment hole (270), said initiator charge plate (320) having a bridgewire (322) and an initiator charge (324), said bridgewire (322) being adjacent to said initiator charge (324), said bridgewire (322), when activated, providing a sufficient temperature rise to detonate said initiator charge(324);

an input charge plate (330) positioned above and aligned with said initiator charge plate (320) via said at least one alignment hole (270), said input charge plate (330) having an input charge (110);

a transfer charge assembly (200) positioned above and aligned with said input charge plate (330) via said at least one alignment hole (270), said transfer charge assembly (200) having a safe position and an armed position, said safe position and said armed position of said transfer charge assembly (200) being activated in response to the application of an electric signal to said transfer charge assembly (200), said transfer charge assembly (200) having a MEMS safety structure (210), said transfer charge assembly (200) having a slider (230) operatively coupled to said MEMS safety structure (210) by a slider spring (250), said slider (230) having an elongated axis (290), said slider (230) having a transfer charge cavity (226) housing a transfer charge (120), said slider (230) having a slider magnet cavity (220) housing a slider magnet (360), said slider (230) having a set of safe indentations (235) and a set of armed indentations (236), said slider (230) being operatively dimensioned and configured to slide along said elongated axis (290) responsive to the operation of said slider inductor (312), said MEMS safety structure (210) having at least one lockpin (240), each said lockpin (240) being operably connected to said MEMS safety structure (210) by a lockpin spring (260), each said lockpin (240) having a lockpin magnet cavity (220) housing a lockpin magnet (360), each said lockpin (240) being operatively dimensioned and configured to move in and out of said safe indentations (235) and said armed indentations (236) responsive to the operation of said lockpin inductor (310);

an output charge plate (350) positioned above and aligned with said transfer charge assembly (200) via said at least one alignment hole (270), said output charge plate (350) having an output charge (130), wherein said input charge (110) and said output charge (130) are located apart from one another along a charge axis (140) perpendicular to said elongated axis (290) of said slider (230);

wherein, in the safe position, said lockpin (240) rests within said set of safe indentations (235), said slider (230) being located so that said transfer charge (120) is apart from and non-aligned with said charge axis (140) between said input charge (110) and said output charge (130); and, wherein, in the armed position, said lockpin inductor (310) affects the movement of said lockpin (240) to retract from said set of safe indentations (235), said slider inductor (312) affects the movement of said slider (230) along said elongated axis (290) of said slider (230) aligning said transfer charge (120) with said charge axis (140) and locating said input charge (110) and said output charge (130), so that upon the detonation of said initiator charge (324) said input charge (110) detonates, and said transfer charge (120) carries a detonation wave across to said output charge (130), thereby detonating said output charge (130).

2. The device of claim 1 wherein said transfer charge assembly (200) is covered with a sealing plate (340) to protect and environmentally seal said transfer charge assembly (200).

3. The device of claim 1 wherein said input charge (110) comprises a pressing of a plurality of layers of explosive.

4. The device of claim 1 wherein said input charge (110) comprises less than about 1 milligram of sensitive primary explosive material.

5. The device of claim 1 wherein said transfer charge (120) comprises a secondary explosive capable of small diameter initiation.

6. The device of claim 1 wherein said transfer charge (120) comprises CL-20 with a binder.

7. The device of claim 1 wherein said transfer charge (120) comprises a primary explosive.

8. The device of claim 1 wherein said transfer charge (120) is housed in a sleeve to increase confinement thereby increasing explosive output power.

9. The device of claim 1 wherein said transfer charge (120) comprises a castable explosive material cast directly into said transfer charge cavity (226).

10. The device of claim 1 wherein said output charge (130) comprises a secondary explosive.

11. The device of claim 1 wherein said MEMS safety structure (210) is a precision-electroformed dual-thickness part.

12. The device of claim 1 wherein the correct installation of said lockpin magnet (360) and said slider magnet (370) is ensured by means of a geometric feature that is common to both said magnets and said lockpin magnet cavity (220) and said slider magnet cavity (225).

13. The device of claim 1 wherein said MEMS safety structure (210) is a multi-thickness element constructed of a metal material that is more shock-resistant than brittle silicon materials.

14. The device of claim 1 wherein said MEMS safety structure (210) includes a simple mechanical latch or pin that permanently locks said slider (230) in its armed position.

15. The device of claim 1 wherein the attractive force between said slider magnet (370) or lockpin magnet (360) and the respective said slider inductor (312) or said lockpin inductor (310) exceeds the respective said slider spring (250) or said lockpin spring (260) return force, thereby allowing said device to remain in its armed position.

16. The device of claim 1 wherein said slider spring (250) or said lockpin spring (260) return force exceeds the attractive force between said slider magnet (370) or lockpin magnet (360) and the respective said slider inductor (312) or lockpin inductor (310) when de-energized, thereby allowing said device to return to its safe position.

* * * * *